United States Patent [19]

Olmr

[11] 4,393,739

[45] Jul. 19, 1983

[54] TOP SHARPENING CHAIN

[75] Inventor: Jaroslav J. Olmr, Columbia, S.C.

[73] Assignee: Textron, Inc., Providence, R.I.

[21] Appl. No.: 247,237

[22] Filed: Mar. 25, 1981

[51] Int. Cl.[3] ..... B27B 33/14

[52] U.S. Cl. ..... 83/834; 30/138

[58] Field of Search ..... 83/830–834; 30/138

[56] References Cited

U.S. PATENT DOCUMENTS

| | | | |
|---|---|---|---|
| 2,608,222 | 8/1952 | Jensen et al. | 83/834 |
| 2,947,331 | 8/1960 | Irgens | 83/834 |
| 2,976,900 | 3/1961 | Mills | 83/834 |
| 2,986,180 | 5/1961 | Irgens | 83/834 |
| 3,020,942 | 2/1962 | Hill | 83/831 |
| 3,261,385 | 7/1966 | Cooper | 83/834 |
| 3,366,150 | 1/1968 | Malloff | 83/833 |
| 3,545,508 | 12/1970 | Tupper | 83/833 |
| 3,929,049 | 12/1975 | Graversen | 83/834 |
| 3,977,288 | 8/1976 | Goldblatt et al. | 83/833 |

*Primary Examiner*—James M. Meister

*Attorney, Agent, or Firm*—Webb, Burden, Robinson & Webb

[57] ABSTRACT

The top sharpening saw chain includes a cutter link having a body portion, an integral cutting element and a depth gauge. The cutting element comprises a top plate having a bottom surface, a top surface face spaced therefrom and terminating rearward thereof and a leading connecting surface extending between the top surface and the bottom surface. The juncture of the connecting surface and the bottom surface defines the only cutting edge of the cutting element.

5 Claims, 7 Drawing Figures

TOP SHARPENING CHAIN

FIELD OF THE INVENTION

My invention relates to saw chains and, more particularly, to the types of saw chains referred to as top sharpening saw chains and which are sharpened by appropriate grinding equipment associated with the chain saw.

DESCRIPTION OF THE PRIOR ART

Top sharpening saw chain has been in existence for some time. Such saw chain is sharpened by various grinding devices attached to the chain saw which engage the chain as it is driven about the chain sprocket. Present top sharpening saw chain still requires hand filing after periodic automatic chain saw sharpenings since these automatic sharpenings change the profile of the cutting edge formed by the top plate and the side plate. Some top sharpening saw chain include cutter links having integral cutting elements and depth gauges which have outer surfaces of approximately the same radius of curvature and which are concentric about a common axis parallel to the pivot axis of the link body and in a plane which is perpendicular to a line joining the pivot axes. Therefore, as sharpening takes place,the cutting element and the depth gauge are reduced evenly to maintain a substantially constant clearance between the outermost portion of the depth gauge and the outer cutting edge of the cutting element. This maintains the desired depth gauge setting which in turn controls the depth of cut of the cutter element. Exemplary of such saw chain is that disclosed in U.S. Pat. No. 3,263,717.

However, such a saw chain still requires hand filing after a certain number of successive chain saw sharpenings since the profile of the cutting element changes as the result of the angular relationships of the top plate and side plate which form the cutting edge. Attempts to improve the sharpening characteristics of such a chain have included selective chrome plating of a portion of the cutting edges as exemplified in U.S. Pat. No. 3,469,610.

Heretofore no one has recognized that a top sharpening chain can be constructed without a side plate forming a part of the cutting element. Nonintegral cutting inserts have been employed which eliminate the need of the side plate in the area of the cutting edge. Representative of those patents are U.S. Pat. Nos. 2,978,800, 2,862,533 and 2,976,900.

Some early saw chain did include integral side plateless cutting elements, but these saw chain were not top sharpenable and did not include hooded cutters. For example, U.S. Pat. No. 2,608,222 discloses a cutting link having a cutting edge termed a tooth which extends outwardly fron the body portion of the cutting link. While the cutting edges comprise entirely the top plate, the top plate is described as being hook-shaped in elevation. Such a link would have to be hand filed and could not comprise a top sharpened saw chain.

SUMMARY OF THE INVENTION

I have provided a top sharpening saw chain in which the geometry of the cutting edge is maintained throughout successive chain saw sharpenings. By maintaining the profile of the cutting element I am able to chain sharpen my saw chain throughout the life of the chain without the need for any hand filing whatsoever.

My integral hooded cutting element of the cutter link comprises a side plateless cutting edge formed at the junction between the bottom surface and the connecting surface which joins the bottom surface and the top surface. The top surface is spaced rearward of the bottom surface and the connecting surface slopes downwardly from its junction with the bottom surface toward the side plate. The connecting surface has a slope of about 12° from the horizontal and the top and bottom surfaces are positioned at about 45° to the horizontal.

DESCRIPTION OF THE PREFERRED EMBODIMENTS

Figure 1:
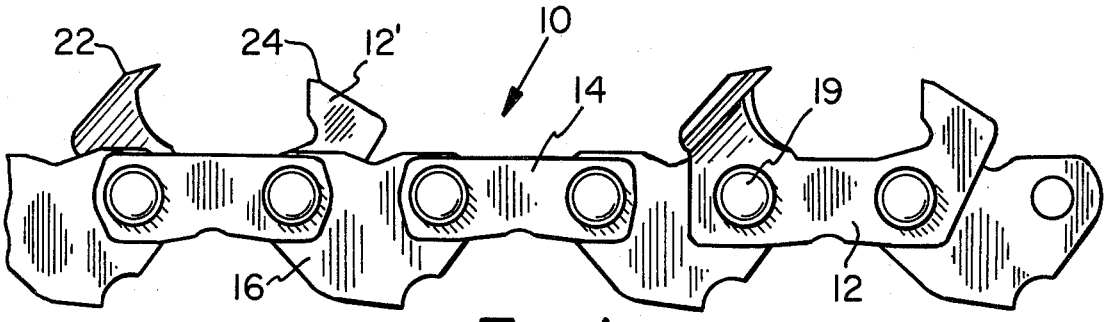
FIG. 1 is a side elevation of a section of saw chain including my invention.
Figure 2:
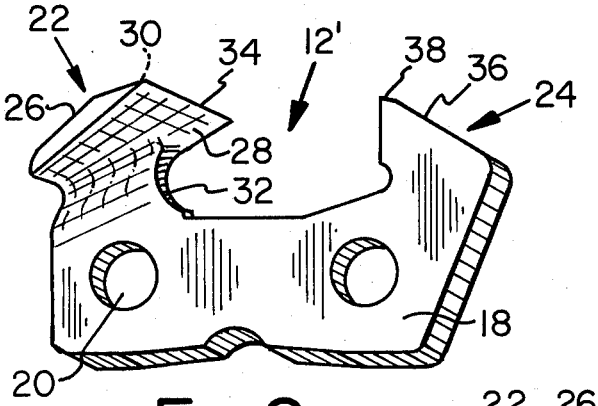
FIG. 2 is a perspective view showing a left-handed cutter link.
Figure 5:
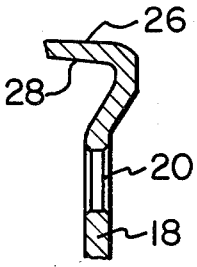
FIG. 5 is a section taken along section lines V—V of FIG. 3.
Figure 3:
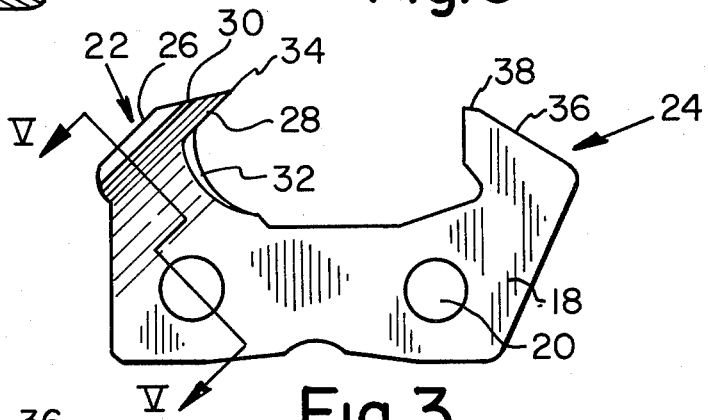
FIG. 3 is a side elevation of the cutter link of FIG. 2.
Figure 4:
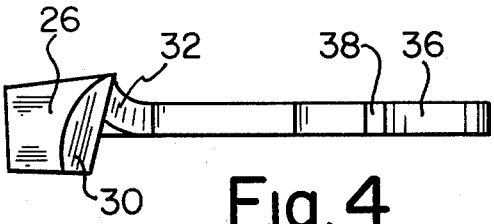
FIG. 4 is a plan view of my cutter link.

My saw chain, generally designated 10, provides cutter links 12 and 12' which include a cutting element 22 which does not include the standard side plate, FIG. 1. The general arrangement of the saw chain 10 includes a right-handed hooded cutter 12, a left-handed hooded cutter 12', drive links 15 and tie straps 14, all joined in pivotable, assembled relationship by rivets 19. The saw chain arrangement is shown in its simplest form and it will be recognized that appropriate safety links may be formed integrally with the drive link 16 or as part of the tie strap 14. Each cutter 12 and 12' has a tie strap on the opposing side thereof. The left-handed cutter 12' and the right-handed cutter 12 appear in alternating sequence and are in allochiral relationship to one another. Each cutter 12 and 12' includes a depth gauge 24 at the forward end in addition to the cutting element 22 located at the rearward end of the link.

The cutter link itself can best be seen in FIGS. 2–5, where only the left-handed cutter is illustrated. Cutter link 12' includes a base portion 18 through which two rivet openings 20 are positioned. The base portion rides along a chain saw bar (not shown). Extending upward from the forward end of base portion 18 is depth gauge 24 which includes an upwardly sloping surfce 36 terminating in a peak surface 38 of lesser slope than surface 36. The decrease in slope of peak surface 38 minimizes the digging in of the depth gauge into the wood and can provide for a better cutting function of the cutting element 22. Cutting element 22 extends upwardly from the rearward portion of the base 18.

The cutting element 22 is comprised of a hood or top plate 28 with no side plate being present as in previous top sharp chains. Top plate 28 includes upper surface 26, lower surface 28 and connecting surface 30 therebetween. Top surface 26 of top plate 22 initiates rearward of bottom plate 28 so that connecting surface 34 extends rearward from its juncture with bottom surface 28. Connecting surface 30 slopes downward and rearward some 12° from a horizontal plane. The juncture of connecting surface 30 and bottom surface 28 forms the cutting edge 34 for the cutter 12'. The cutting element 22 blends into the base 18 through surface 32 extending downwardly from the lower surface 28. Surface 32 is located rearward of cutting edge 34 and along a side of bottom surface 28 so as to define an area of clearance so the chips can escape under the top plate. Surface 32 can be arcuate as shown or can be straight with a minimal connecting radius. Upper surface 26 and lower surface 28 slope rearwardly from the horizontal at about 45°.

Figure 6:
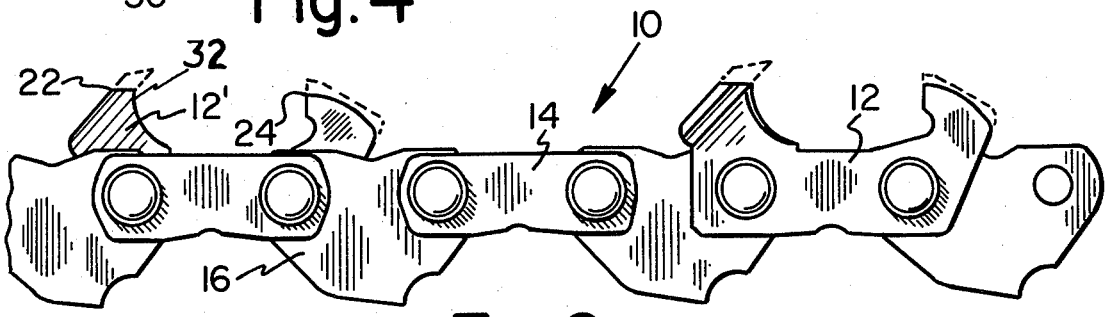
FIG. 6 is a side elevation of the section of saw chain of FIG. 1 after a number of sharpenings.

The cutter element 22 and the depth gauge 24 are positioned with respect to each other so that when engaged by the sharpening stone of the chain saw the depth gauge setting is progressively reduced over the life of the chain. This reduction in depth gauge setting is easily compensated for by a slight increase in cutting pressure applied to the chain saw over the life of the chain. The cutting edge is reduced in vertical height on the order of 0.0060 inch while the depth gauge setting is reduced from about 0.018 inch to 0.001 inch. This can best be seen in FIG. 6 where saw chain 10 has gone through a series of successive sharpenings and both the cutter element 22 and the depth gauge 24 have been reduced. The dotted lines represent the material which has been removed from the cutting element and depth gauge. The top plate has been effectively removed and the remaining surface 32 defines a negative angle which precludes further cutting.

Figure 7:
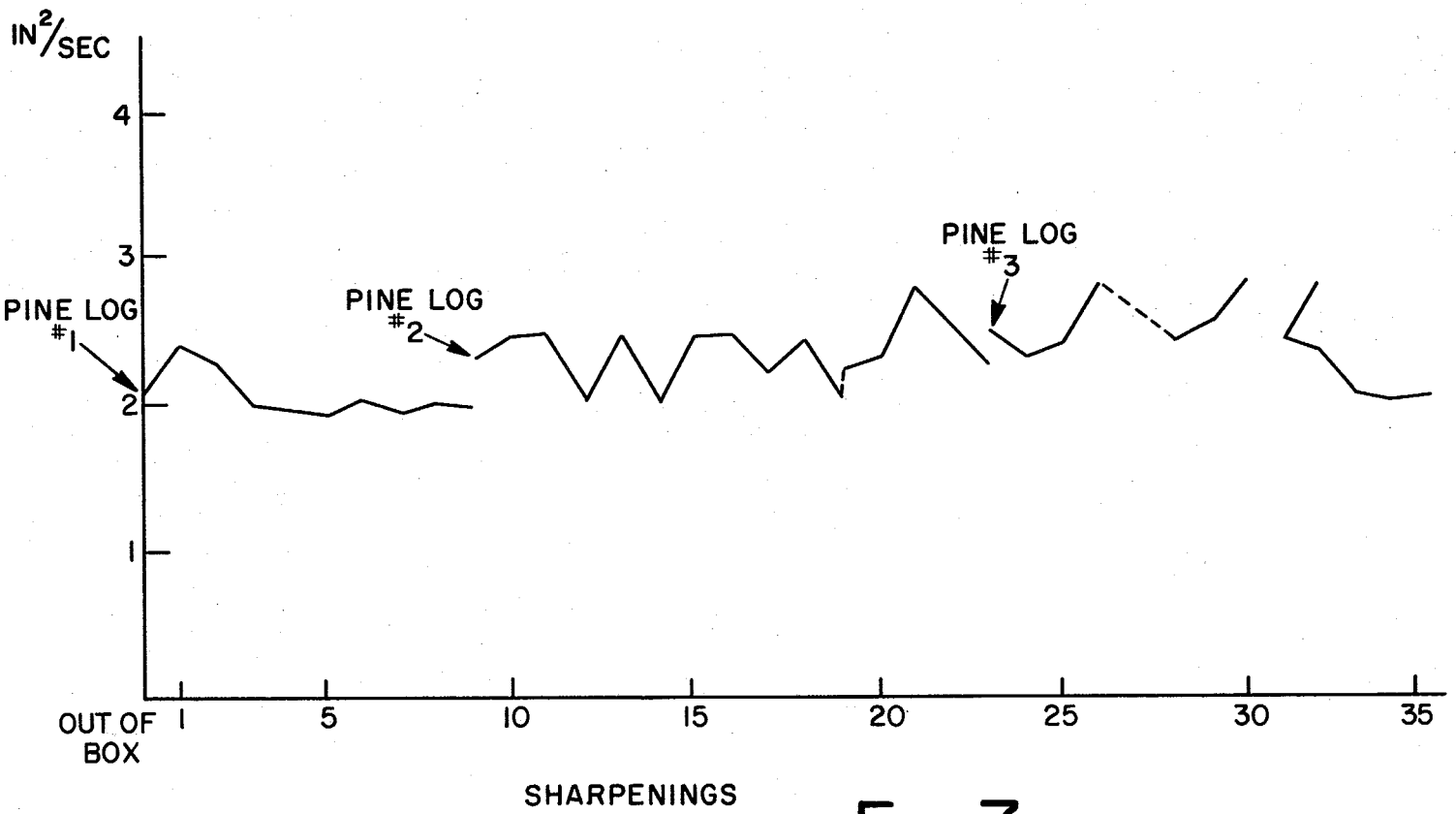
FIG. 7 is a graph showing the sharpening performance of my saw chain through successive sharpenings.

Because the profile of the cutter element does not change on successive sharpenings, the cutter maintains its cutting efficiency throughout successive sharpenings. This is illustrated in FIG. 7 which is a graph showing the sharpening performance through 35 successive sharpenings. The cutting efficiency, which is the ordinate of the graph, represents the amount of surface area removed per unit time. Cuts through a series of pine logs were made in the out-of-box condition and through 35 consecutive sharpening cycles. It can be seen that cutting performance remains a constant throughout the life of the chain and that a large percentage of the variation which is present in cutting efficiency occurred when the chain went through different logs rather than different sharpening cycles. In the standard top sharp chain which includes a side plate, the profile of the cutting edge changes through successive sharpenings and it is recommended that the chain be hand sharpened after every five automatic sharpenings on the chain saw itself. My cutter link maintains its cutting efficiency and completely eliminates the need for any hand sharpening as evidenced by the constant cutting efficiency shown in FIG. 7.

I claim:

1. In a top sharpening saw chain cutting link formed of a single piece and sharpenable by a grinding device attached to a chain saw and including a body portion, a depth gauge and an integral hooded cutting element, the improvement comprising a side plateless cutting element including a top plate having a bottom surface, a top surface spaced therefrom and initiating rearward thereof at a leading end, and a leading end connecting surface extending between the top surface and bottom surface, a juncture between the connecting surface and the bottom surface defining the only cutting edge of the cutting element, said top plate connecting to said body portion through a surface located rearward of said juncture and along a side of said bottom surface so as to define an area of clearance for chip passage.

2. The link of claim 1 wherein the connecting surface slopes downwardly and rearwardly from said juncture with the bottom surface toward said top plate.

3. The link of claim 2, said connecting surface having a slope of about 12° from the horizontal when said link is positioned on a horizontal plane.

4. The link of claims 1, 2 or 3 wherein said top and bottom surfaces are substantially parallel and slope about 45° from the horizontal when said link is positioned on a horizontal plane.

5. A top sharpening endless saw chain sharpenable by a grinding device attached to a chain saw and comprising in repetitive sequence a right-handed cutter link and tie strap pair pivotally connected to preceding and succeeding center drive links and a left-handed cutter link and tie strap pair pivotally connected to preceding and succeeding center drive links, said preceding and succeeding center drive links of right and left-handed cutter pairs being separated by at least one set of tie straps, each cutter link including a body portion, an integral cutting element and depth gauge formed of a single piece, said cutting element including a top plate having a bottom surface, a top surface spaced therefrom and initiating rearward thereof at a leading end, and a leading end connecting surface sloping downward and rearward from the bottom surface to the top surface, a juncture between the connecting surface and the bottom surface defining a side plateless cutting edge, said top plate connecting to said body portion through a surface located rearward of said juncture and along a side of said bottom surface so as to define an area of clearance for chip passage.

* * * * *